US011667411B2

(12) United States Patent
de Jong et al.

(10) Patent No.: US 11,667,411 B2
(45) Date of Patent: Jun. 6, 2023

(54) FLAP FOLDING UNIT, FLAP FOLDING APPARATUS, FLAP FOLDING METHOD AND SYSTEMS AND METHODS USING THE SAME

(71) Applicant: Sparck Technologies B.V., Drachten (NL)

(72) Inventors: Olaf de Jong, Drachten (NL); Melle Jonker, Drachten (NL)

(73) Assignee: SPARCK TECHNOLOGIES B.V., Drachten (NL)

( * ) Notice: Subject to any disclaimer, the term of this patent is extended or adjusted under 35 U.S.C. 154(b) by 0 days.

(21) Appl. No.: 17/401,751

(22) Filed: Aug. 13, 2021

(65) Prior Publication Data

US 2022/0048651 A1 Feb. 17, 2022

(30) Foreign Application Priority Data

Aug. 14, 2020 (DE) ..... 10 2020 121 483.9

(51) Int. Cl.
*B65B 5/02* (2006.01)
*B65B 59/00* (2006.01)
*B65B 43/10* (2006.01)

(52) U.S. Cl.
CPC ..... *B65B 5/024* (2013.01); *B65B 43/10* (2013.01); *B65B 59/001* (2019.05); *B65B 2210/04* (2013.01)

(58) Field of Classification Search
CPC ..... B31B 50/52; B31B 50/0044; B31B 50/62; B31B 2120/10; B31B 2120/102; B31B 2100/00; B31B 2105/00; B31B 2110/35; B65B 7/26; B65B 7/28; B65B 7/20; B65B 7/2807; B65B 7/2871; B65B 5/024; B65B 59/001; B65B 43/10; B65B 2210/04
See application file for complete search history.

(56) References Cited

U.S. PATENT DOCUMENTS

| | | | |
|---|---|---|---|
| 3,694,999 | A | 10/1972 | Switliski et al. |
| 3,913,300 | A | 10/1975 | Benzing |
| 3,979,883 | A | 9/1976 | Patsaros |
| 4,420,924 | A | 12/1983 | Hoyrup et al. |
| 6,048,421 | A | 4/2000 | White |
| 6,598,375 | B2 | 7/2003 | Connelly |
| 2003/0009985 | A1 | 1/2003 | Close et al. |

(Continued)

FOREIGN PATENT DOCUMENTS

| | | | |
|---|---|---|---|
| EP | 3015373 | A1 | 5/2016 |
| WO | 2005075185 | A1 | 8/2005 |

(Continued)

OTHER PUBLICATIONS

"International Fibreboard Case Code," published by FEFCO and ESBO, 2007, 11th edition.

(Continued)

*Primary Examiner* — Thomas M Wittenschlaeger
(74) *Attorney, Agent, or Firm* — Cozen O'Connor

(57) ABSTRACT

A flap folding unit (90) for folding flaps of lids of boxes, comprising a hinged guiding element (94) adapted for contacting a flap to be folded upon relative movement of the guiding element and the flap and guiding the flap towards its intended final position and an extendable pusher (96) adapted for pushing the flap into its intended final position.

14 Claims, 12 Drawing Sheets

(56) References Cited

U.S. PATENT DOCUMENTS

| | | | | |
|---|---|---|---|---|
| 2008/0110135 | A1 | 5/2008 | Jacob et al. | |
| 2015/0360433 | A1* | 12/2015 | Feijen | B31B 50/74 493/162 |

FOREIGN PATENT DOCUMENTS

| | | | |
|---|---|---|---|
| WO | 2014117817 | A1 | 8/2014 |
| WO | 2014118629 | A2 | 8/2014 |
| WO | 2016059218 | A1 | 4/2016 |
| WO | 2019081773 | A1 | 5/2019 |

OTHER PUBLICATIONS

Extended EP Search Report dated Jan. 14, 2022, EP App No. 21191377.7-1016—7 pages.

* cited by examiner

FLAP FOLDING UNIT, FLAP FOLDING APPARATUS, FLAP FOLDING METHOD AND SYSTEMS AND METHODS USING THE SAME

TECHNICAL FIELD OF THE INVENTION

The invention relates to a flap folding unit adapted for folding flaps of lids of boxes, in particular custom-sized cardboard boxes. The invention also relates to a flap folding apparatus comprising such flap folding unit, and a method for folding the flaps of lids onto boxes, in particular custom-sized cardboard boxes. The unit, the apparatus and the method are particularly useful in systems for automatically packaging shipment sets, i.e. sets of one or more items to be shipped, in particular varying shipment sets, in which at least the number, and usually the number and the size of the items vary, in custom-sized boxes made from cardboard blanks. The invention also relates to a system and a method for automatically packaging varying shipment sets in custom-sized cardboard boxes.

TECHNICAL BACKGROUND

Mail ordering has become a widely used way of buying goods. More and more companies offer online shops, in which the customers can electronically put goods in a virtual shopping cart that later will be transferred by the respective company into a dispatch order so that in a warehouse a shipment set comprising the items ordered (and sometimes additional items such as samples, vouchers, invoices, void-fill etc.) can be assembled based on the respective dispatch order.

While assembling a shipment set in a warehouse of a specialized distributor is nowadays often done fully automated, packaging the shipment set is still a challenge, in particular when a shipment set comprises several items of different sizes and in different quantities. Often, the items to be packaged are provided automatically to a person packaging the items manually. Depending on the size and number of the items, the person selects a suitable box size.

To automate the packaging process even in cases where the items forming a shipment set vary in size and number, different systems have been proposed. One approach is shown in WO 2016/059218 A1, which discloses a system and a method for automatically packaging varying shipment sets, which system and method employ two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

A different approach is shown in WO 2014/118629 A2 and WO 2014/117817 A1, which teach methods and systems that allow—within the boundaries imposed by the material used—creating a fully custom-sized box, i.e. a cuboid box, of which width, length and height are adapted to the respective content of the box.

Such systems create boxes by first obtaining information on the outer dimensions length, width and height of the shipment set to be packaged and calculating based on this information the layout of a custom-sized cardboard blank (sometimes called template or piano) comprising different so called panels, which are delimited from each other by crease lines or indentations and incisions allowing the panels to be folded in order to create the box wanted. A piece of cardboard supplied from a roll of cardboard or a stack of zig-zag cardboard is then cut-off, indented and incised (not necessary in this order) to form the blank. Depending on the specific way the system works, a box with or without an attached lid may then be formed automatically by gripping and folding the blank.

The "International Fibreboard Case Code" published by FEFCO and ESBO, 2007, $11^{th}$ edition, discloses under item 0300 a box (hereinafter referred to as "type 0300" box), which is very stable and yet very easy to manufacture as the layout of the corresponding blank, from which the box is folded, is rather simple. Each box comprises a rectangular bottom panel having four edges, a first and a second rectangular end panel, each joined over a crease line to opposite edges of said bottom panel, a first and a second rectangular side panel, each joined over a crease line to opposite edges of said bottom panel, two first and two second rectangular corner panels, the first corner panels joined over respective crease lines to opposite edges of the first end panel, and the second corner panels joined over respective crease lines to opposite edges of the second end panel. As the blank typically is moved in a transport direction through a system for automatically forming custom-sized boxes, the first end panel is also called front end panel and the respective first corner panels attached to it are called front corner panels, as these panels form the front of a blank moving through the system, while the second end panel is called for the corresponding reason the rear end panel, and the second corner panels attached to it are called rear corner panels. In the erected state, the two end panels and the two side panels form the side walls of the box.

It should be noted that due to the thickness of the cardboard, the so-called crease lines are not thin lines as for folding paper, but are rather "crease grooves". However, following the terminology common in the art, the term crease line is used herein.

It should be also noted that in case of rectangular bottom panels, the term "width of the bottom panel" as used herein refers to the extension of a respective bottom panel in the direction of the width of the cardboard supplied for making the box, and "length of the bottom panel" refers to extension in the direction of the length of the cardboard supplied, which is also the direction, in which the cardboard is transported into and inside a system for creating custom-sized boxes. Seen in this transport direction, the end panels of the box are in front and behind the bottom panel, while the side panels of the box are to the left and the right of said bottom panel. The term "outer dimensions" refers to the dimensions of the panels on the outside of the erected box.

Boxes like the type 0300 boxes, also called "tray boxes", have no attached lids and can be closed for example with lids having the same structure as the boxes, i.e. lids with corner panels, such as a "type 0300" lids shown under item 0300 in said FEFCO/ESBO publication or with lids having an even simpler blank layout such as the lids shown under item 0302 in said FEFCO/ESBO publication (so-called "type 0302" lids). In the layout of a type 0302 lid, the corner panels are cut away, so that the lid comprises just a rectangular top panel having four edges, and four rectangular flaps, each flap joined over a crease line to one edge of the top panel and each flap adapted for being folded onto a respective side wall of a box panel, where it is fixed for example by glue or an adhesive tape. If the boxes are made from cardboard, the lids may be created from the same type of cardboard as the boxes or from a different type.

Known systems for creating custom-sized tray boxes and corresponding separate closing lids from cardboard being continuously supplied to the systems in particular from stacks of zig-zag folded cardboard, can be set up to produce type 0300 boxes and corresponding lids or combinations of such boxes with, e.g., type 0302 lids by first cutting out and creasing a custom-sized blank, from which a box is folded automatically around the shipment set to be packaged after placing the shipment set consisting of one or more of item(s) on the blank. Such systems comprise structure for cutting (which may also include die cutting. i.e. punching out certain parts), like rotating or reciprocating knifes, lasers, die cutters etc., structure for creasing, like crease rollers or moving stamps, structure for folding the cardboard, like moveable grippers and flaps, and structure for attaching the respective panels to each other, like a glue unit for applying hot melt glue to one or both of two overlapping panels. Upon erecting a box, the system would first fold the corner panels upwards, then the end panels upwards and thus the corner panels, which are joined to the end panels, inwards, and finally the side panels upwards.

While the known systems and methods for automating the packaging process work well for a number of applications, and in particular the system disclosed in WO 2014/117817 A1 has proven to allow packaging items varying in size and number fully automatically, it has turned out that there is still room for optimization of the packaging process.

A particular challenge is automatically closing the above mentioned tray boxes, i.e. boxes like the type 0300 boxes, which have no attached lids, with separate cardboard lids such as the type 0302 or type 0300 lids, and various systems and methods using different approaches have been proposed to improve placing and fixing lids on boxes. For example, US 2003/0009985 A1 discloses a system that takes a flat cardboard blank, which has been pre-cut and pre-creased to define a type 0302 lid, from a stack of such blanks, places it on an open box, folds the flaps onto the side walls of the box and winds straps around the box to close it. U.S. Pat. Nos. 4,420,924 and 3,694,999 disclose methods for placing pre-assembled lids like type 0300 lids on corresponding boxes. U.S. Pat. No. 6,598,375 B2 discloses a system for automatically placing lids on boxes that are almost completely filled with items having the shape of the boxes and thus providing sufficient stability for pressing the flaps of the lid against the side walls of the box. However, when shipment sets of varying items are packaged, the items often do not fully fill out the respective box and the side walls of the box can easily bend inwards (and thus away from the flap of the lid) when pressure is applied to the outside of a respective side wall when the corresponding flap of a lid or an adhesive tape is pressed against the side wall for gluing the flap to the side wall respectively for joining the side wall with the flap via the adhesive tape. This can lead to little or no adhesion between the side wall and the flap or between the tape and the side wall. While in the regions of the corners of adjacent side walls the boxes typically have sufficient stability, the aforementioned problem increases as the box size increases, since the regions between the corners become more flexible. This problem is particularly relevant in systems for automatically packaging varying shipment sets in custom-sized boxes. In such systems, the sizes of the boxes can vary to a great extend.

To at least partially solve this problem, a system has been proposed in U.S. Pat. No. 6,048,421 for closing tray boxes with type 0302 lids, which is based on the idea to press the top panel of the lid slightly into the box to create some outward directed pressure on the side walls of the box. The respective system employs L-shaped levers cooperating with flap-guiding elements. At the free end of each L-shaped lever, an elongated bar is attached that is adapted to run parallel to a crease line delimiting a flap from the top panel of a lid. In use, after placing a flat pre-cut and pre-creased blank for a lid on a box to be closed, the lever and the guiding element are brought into contact with the blank such that the bar contacts the blank on the top panel close to a crease line delimiting a flap and presses the top panel slightly into the box, which creates some outward directed pressure on the side wall of the box, which prevents a side wall from simply bending inwards when the respective flap is folded by the guide element onto the side wall. As the levers and the guiding elements are mounted on a common structure and are moved together, the adjustability of the system is somewhat limited. The elongated bar also requires that there is always a minimum distance between two parallel side walls of a box adjacent to and spaced apart by the side wall against which the top panel is pressed by the bar, as otherwise the bar would damage said adjacent side walls.

Another problem that is particularly relevant in systems for automatically packaging varying shipment sets in custom-sized cardboard boxes and closing the boxes with a respective custom-sized cardboard lid is that due to the inherent properties of the material and the way this material it is handled in systems that create custom-sized boxes and lids at high speed, the boxes and the lids are always created with certain tolerances and slight deviations.

DISCLOSURE OF THE INVENTION

One object of the invention is to provide an alternative solution for automatically attaching flaps of lids to the side walls of boxes that is particularly useful in cases of custom-sized boxes and which improves the aforementioned known methods and systems in at least one aspect.

The object is achieved by a flap folding unit according to claim 1, a flap folding apparatus according to claim 6, and a flap folding method according to claim 13. Independent claims 14, 15 and 16 relate to a system for closing tray boxes respectively to a system and method for automatically packaging items in custom-sized boxes. The respective dependent claims relate to advantageous embodiments of the respective independent claims.

One basic concept of the invention is to use flap folding units comprising a hinged guiding element and an extendable pusher. In use, such flap folding units will be moved parallel to the side wall of a box, onto which a flap is to be folded, such that the hinged guiding element makes a first soft contact with the flap to be folded and presses it toward its intended final position on the side wall. In a known manner, hot-melt glue or other glue will be applied prior to folding the flap onto the side wall, in particular at positions where the pushers of the flap folding units are contacting the respective flaps. Using hinged guiding elements for making first contact has several advantages. For example, the guiding elements provide for a soft contact with the flaps, preventing indenting the flaps or even damaging them. Furthermore, as will be described below, the hinged elements allow larger tolerances between the flap folding units and the lids, which is useful in particular in high speed system for creating custom-sized cardboard boxes and respective lids that due to the inherent properties of the material treated need greater tolerances. When the flap folding unit comprises a mounting body holding the guiding element and the extendable pusher, the guiding element may be spring-preloaded towards a position away from the mounting body.

In one embodiment, each pusher is extended in a controlled manner by a piston-cylinder-unit or an electric actuator such as a step-motor, which facilitates pressing a respective flap of a lip onto a respective side wall of a box in a well-defined manner that prevents pressing the flaps too much into the side wall while ensuring sufficient contact between the flaps and the side walls and allowing the glue to settle. Depending on the type of box and glue used, different pushers along each flap can be extended slightly differently, for example the pushers adjacent to corners of boxes and lids may be extended less than those pushers close to the middle of a respective flap, where typically the flap and the box are most flexible. To facilitate movement of the pusher while ensuring a compact structure of the flap unit, in a preferred embodiment the hinged guiding element comprises an opening, through which the pusher is extendable for pushing the flap.

While typically the boxes and lids in the folded state will be substantially cuboid, the invention is not limited to such boxes and may advantageously be as well used with boxes and lids having any type of polygonal bottom panels and respective top panels, i.e. triangular, quadrangular, pentagonal, hexagonal etc. bottom and top panels. While typically the invention will be used for closing tray boxes, it can also be used for closing other types of boxes as will be described below.

A flap folding apparatus according to one embodiment comprises a plurality of flap folding units as described above and structure for moving the plurality of flap folding units relative to a lid comprising at least one flap to be folded. In order to ensure that lids of different sizes can be treated, preferably the distance between at least some of the flap folding units is automatically adjustable. To achieve that, one option is to arrange some flap folding units on a common rail, along which they are automatically positionable with respect to each other.

In one embodiment, all flap folding units are arranged on a common structure for moving them in a direction substantially perpendicular to a top panel of a lid comprising the flaps to be folded. Typically, a lid will be placed on top of a box, and all flap folding units will be lowered together in a vertical direction onto the lid.

To further allow treating differently sized lids comprising at least two flaps at opposite sides, the apparatus in one embodiment comprises a first plurality of said flap folding units arranged along a first one of said flaps and a second plurality of said flap folding units arranged along a second one of said flaps, and structure for adjusting the distance between said first and said second plurality of flap folding units. Typically, the lid to be handled by the apparatus will comprise a rectangular top panel and four flaps, and accordingly the apparatus will comprise four pluralities of flap folding units arranged in opposite pairs.

In one embodiment, in which each flap folding unit comprises a mounting body holding the guiding element and the extendable pusher, the apparatus further comprises structure for adjusting the distance of each mounting body to an adjacent side wall of a box, onto which a flap of a lid is to be folded such that a gap remains between the mounting body and the respective flap in the folded position. By this, tolerances in the dimensions of the boxes and the lids can be taken into account, while ensuring that when the hinged elements make contact with the flaps, the lid still can move a bit, which will ensure automatic alignment of the lid with the box.

Further details and advantages of the invention will become apparent from the following detailed description of embodiments in conjunction with the drawing, which comprises 16 drawing figures.

DESCRIPTION OF PREFERRED EMBODIMENTS

Figure 1:
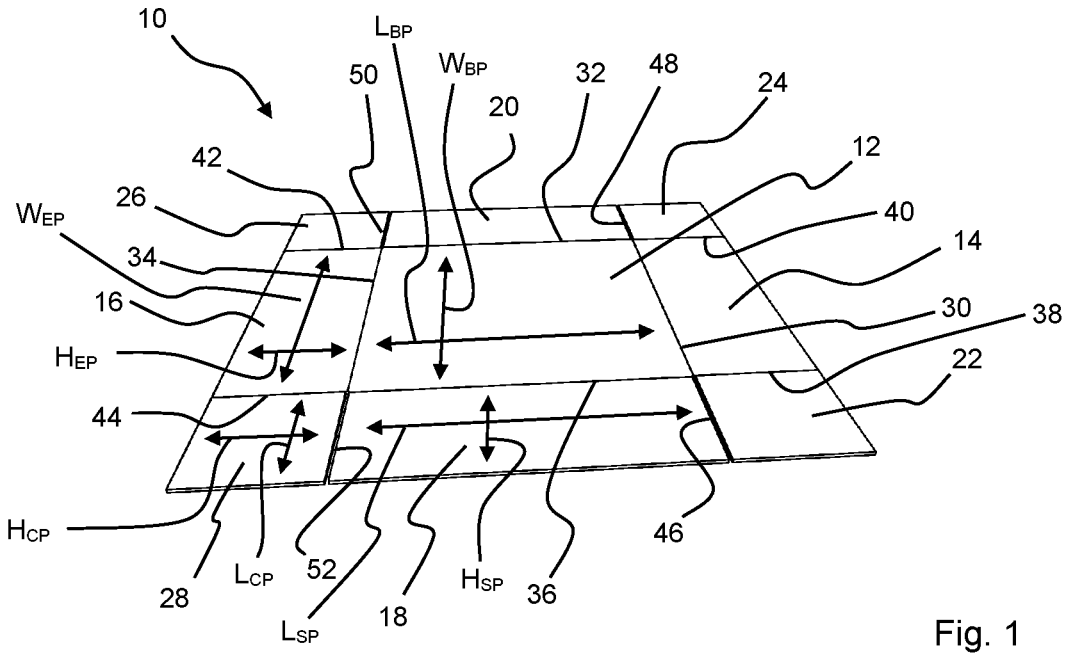
FIG. 1 is a perspective view of a cardboard blank for folding a tray box.
Figure 2:
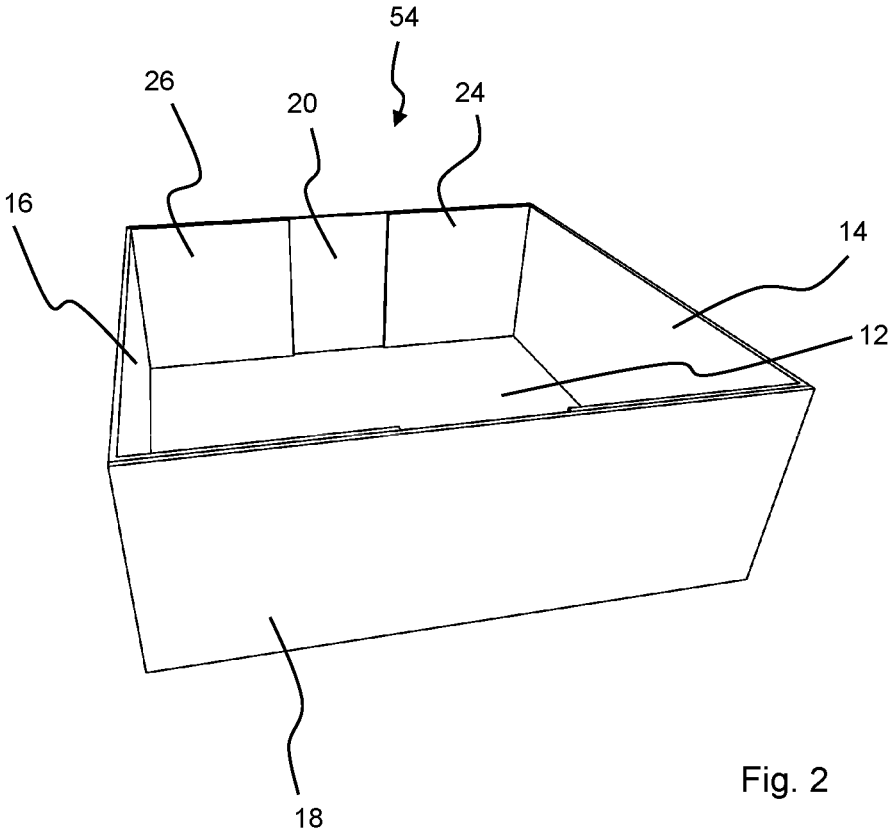
FIG. 2 is a perspective view of a box folded from the blank shown in FIG. 1.

FIG. 1 shows a blank 10 for a type 0300 box, having a bottom panel 12, a first end panel 14, a second end panel 16, a first side panel 18, a second side panel 20, two first corner panels 22 and 24 joined to opposite edges of the first end panel 14 and two second corner panels 26 and 28 joined to opposite edges of the second end panel 16. The panels are delimited against each other via eight crease lines 30-44 respectively four slots 46, 48, 50 and 52. The crease lines 38 and 44 are with respect to the crease line 36 slightly shifted, namely to an amount corresponding to the thickness of the cardboard towards the first end panel 14 respectively towards the second end panel 16. Likewise, the crease lines 40 and 42 are with respect to the crease line 48 shifted in an amount corresponding to the thickness of the cardboard towards the first end panel 14 respectively towards the second end panel 16. Thus, the width $W_{EP}$ of the end panels 14 and 16 is slightly less than the width $W_{BP}$ of the bottom panel 12. This allows that in the erected state as shown in FIG. 2, the corner panels 22 and 28 run perfectly parallel to the side panel 18 and the corner panels 24 and 26 run parallel to the side panel 20, forming a tray box 54.

Shifting the crease lines 38 and 44 with respect to the crease line 36, and shifting the crease lines 40 and 42 with respect to the crease line 32 also leads to the fact that the length $L_{CP}$ of the corner panels is to the amount of shifting greater than the height $H_{SP}$ of the side panels.

The slots 46, 48, 50 and 52 are also dimensioned to take into account the thickness of the cardboard: the height $H_{CP}$ of the corner panels has to be decreased by the thickness of the cardboard as in the erected state these corner panels abut against the bottom panel while the top side of the corner panels shall, in this type of box, be level with the top end of the end panels. The height $H_{EP}$ of the end panels 14 and 16 corresponds to the height $H_{SP}$ of the side panels 18, 20, which in this type of box defines the maximum height of the box. However, the invention is not limited to this type of boxes, but can for example also be used with boxes such as the ones disclosed in WO 2019 081773 A1 or other types.

Due to the inherent properties of the material, the slots are typically not made such that only the height $H_{CP}$ of the cornel panels is shortened, but also the length $L_{SP}$ of the side panels, which facilitates erecting the box and ensures that the side panels do not extend beyond the end panels in the erected state. Hence, the length $L_{SP}$ of the side panels 18, 20 is typically a bit shorter than the length $L_{BP}$ of the bottom panel 12. The first end panel 14 is considered here to be the above mentioned front end panel, i.e. the panel that forms the front of the blank in a processing direction, in which it is transported through a system for creating boxes, whereas the second end panel 16 forms the above mentioned rear end in that direction and is accordingly called rear end panel. Likewise, the first corner panels 22 and 24 are called front corner panels, whereas the second corner panels 26 and 28 are called rear corner panels. In the erected state, the first and second end panels 14 and 16 and the side panels 18 and 20 form the side walls of a box. As with respect to closing the box with a lid it is in most cases irrelevant, which panel forms which side wall, the end panels and the side panels will later on simply be addressed as "side walls" of the box.

Figure 3:
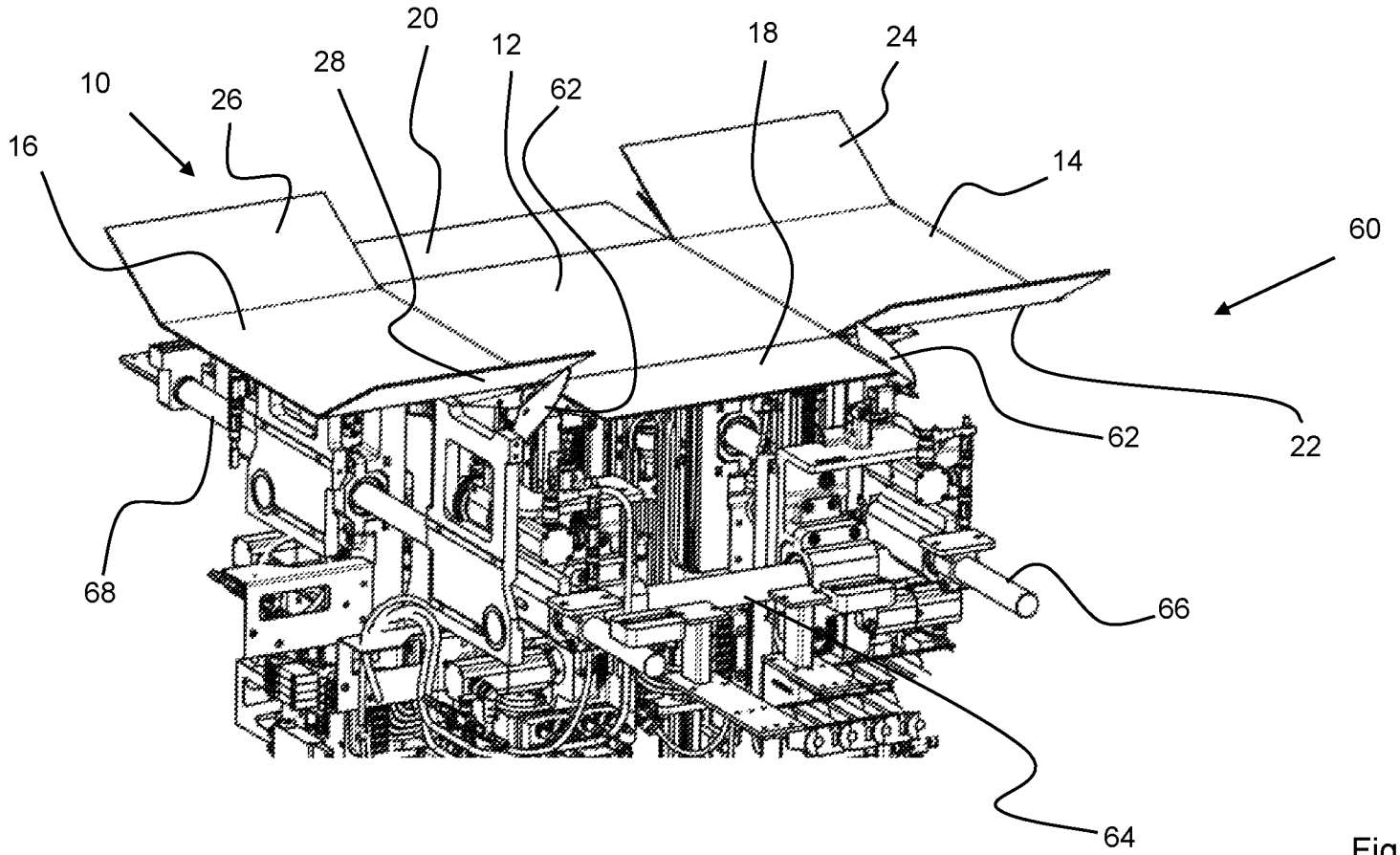
FIG. 3 shows some parts of a folding station for folding cardboard blanks.

FIG. 3 shows schematically some parts of a folding station 60 according to the prior art for folding cardboard blanks like the blank 10 shown as one example in FIG. 1 to form packaging boxes. The blank 10 has a slightly different layout than the blank shown in FIGS. 1 and 2 (the height of the end panels 14 and 16 is greater than the height of the side panels 18 and 20), but both layouts and other layouts may equally be treated according to the invention.

The folding station 60 shown comprises four folding units, each comprising a corner panel folding element 62, of which in the shown situation, in which a cardboard blank 10 has been placed on the folding station and the corner panel folding elements 62 have started to push the corner panels 22, 24, 26 and 28 upwards, only two are visible.

The folding units are slidably mounted on rods 64, 66 and 68 in order to be moveable in a plane parallel to the plane of the cardboard blank 10, as the cardboard blanks to be folded may in this embodiment differ in size and hence the positions of the panels of the cardboard blank to be folded by the folding station 60 may vary from blank to blank. The shown folding station 60 is of exemplary nature to facilitate understanding the folding process.

The folding station 60 forms part of an automatic packaging system, in which custom sized boxes and corresponding lids can be created from cardboard fed into the system usually from stacks of zig-zag folded cardboard and in which items to be shipped are automatically packaged in the boxes formed. Such system is disclosed for example in WO 2014/117817 A1. Such automatic packaging system comprises a blank forming apparatus, in which the cardboard is cut and creased to form a custom sized blank, which then can be folded automatically. The system also comprises one or more glue application units (not shown in these schematic drawings) for applying glue on at least one of the panels of the blank 10 that are to be glued together. Such glue application unit may be adapted to apply portions of hot melt glue with at least two different surface-to-volume ratios, which can contribute to speeding up the whole process as a portion having a higher surface to volume ratio may cure faster and thus fix the panels provisionally, while a portion having a lower surface to volume ratio may contain more glue and may lead, once cured, to a stronger bond. The glue application unit may also be adapted to apply portions of hot melt glue on the side walls of the erected box and/or on the flaps of a lid for adhering the flaps to the side walls. Depending on the general layout of the system, it may be more efficient to provide one or several separate glue application units for separate gluing steps.

It should be noted that the glue can in principle be any adhesive, while it will typically be hot melt glue, which is easy to handle in automated systems and cures fast. For sake of simplicity, in the following it will be assumed that the glue is hot melt glue and the process in which it hardens and binds those parts, between it is placed, together will be denoted as curing, although the invention is equally useful if other types of glue are used, that may not harden but that will stay flexible even when the glue has set. Thus, the invention is not limited to systems using hot melt glue.

Figure 4:
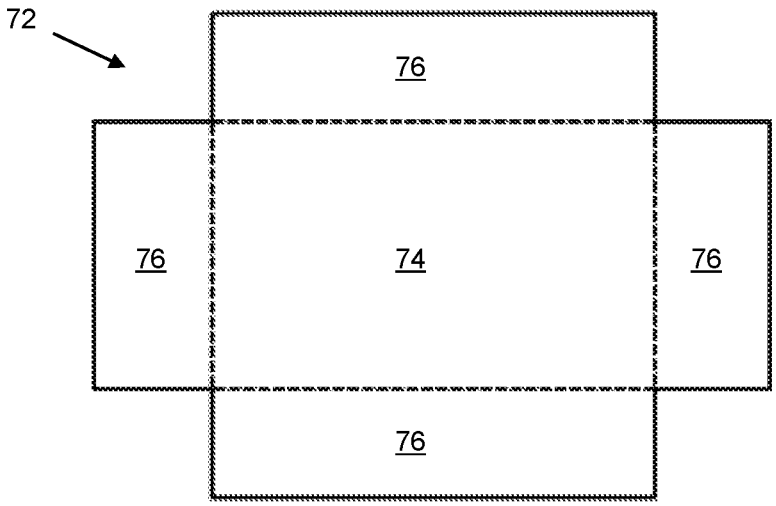
FIG. 4 is a plan view of a FEFCO type 0302 lid for closing a tray box as shown in FIG. 2.

FIG. 4 shows a typical FEFCO type 0302 lid 72 for closing a tray box. This type of lid comprises a top panel 74 and four flaps 76, which are to be folded onto respective side walls of the tray box to be closed. The flaps and the top panel are delimited with respect to each other by crease lines shown as dashed lines.

Figure 5:
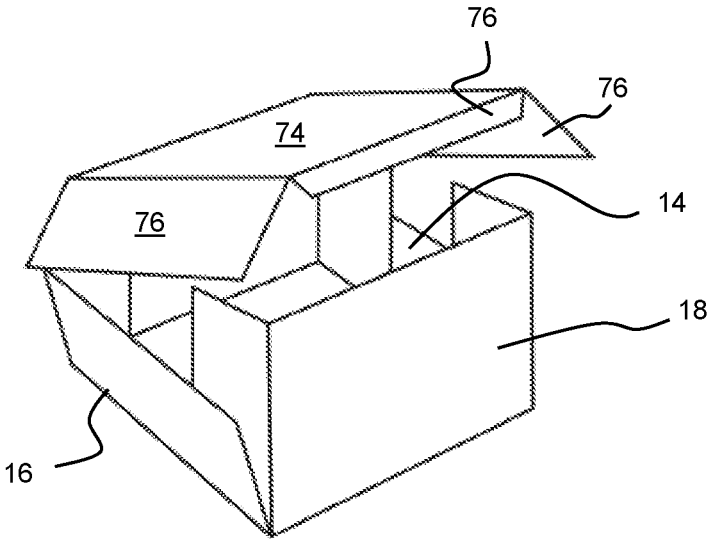
FIG. 5 is a perspective view of a FEFCO type 0406 box having an attached lid with three flaps.

While the invention typically will be used for closing tray boxes with lids as shown in FIG. 4, the invention is equally useful for folding flaps of other types of lids and boxes, such as for example the FEFCO type 0406 box shown in FIG. 5. Such box has an attached lid formed by a top panel 74 and three flaps 76, which are to be folded on respective side panels 14, 16, and 18 of the box.

Figure 6:
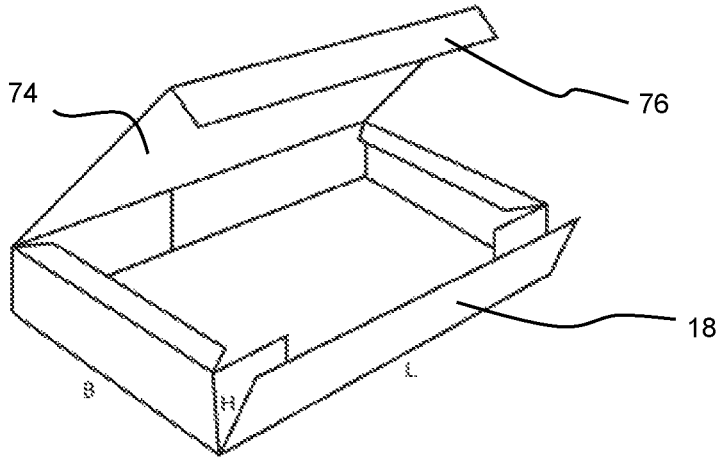
FIG. 6 is a perspective view of a FEFCO type 0403 box having an attached lid with one flap.

FIG. 6 shows a FEFCO type 0413 box having an attached lid formed by a top panel 74 and one flap 76 that is to be folded onto a side wall 18 of the box.

Figure 7:
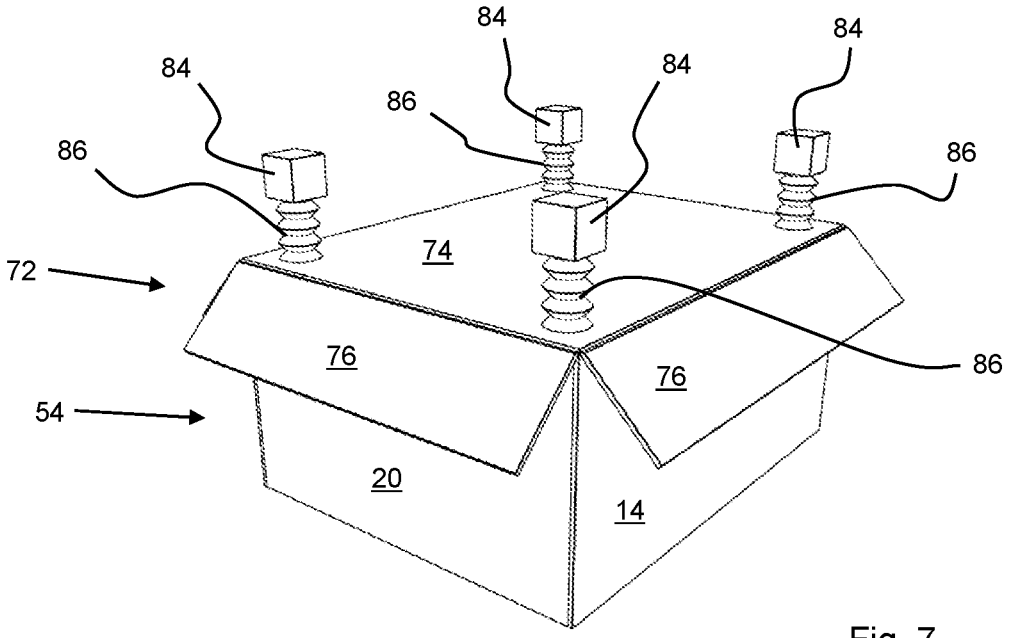
FIG. 7 is a perspective schematic drawing of some elements of a lid placing station for placing a lid on a tray box, in which the flap folding units are not shown.

In order to facilitate understanding the invention, FIG. 7 shows schematically positioning a lid 72 according to FIG. 4 on a box 54, which is in this case done by means of four suction units 84, each comprising an elastic suction cup 86 and connected to structure (not shown) like a vacuum pump for applying a vacuum to the elastic suction cups 86, so that the lid, or to be precise, the top panel 74 is firmly gripped by the suction cups. Not shown in this drawing are the flap folding units, which will be positioned along each flap to be folded as will be described later.

In the situation shown in FIG. 7, the flaps 76 hang down from the top panel 74 along the crease lines due to their weight and are thus already partially folded towards their intended final position on the side panels of the box 54, of which in this view only two, namely the side panels 14 and 20 are visible. However, for the present invention it does not play a role whether or not the flaps hang down. Depending on the size of the flaps and the strength of the material used for the lid, in most cases the panels 74 and 76 will more or less be in one plane, just delimited by respective crease lines. Typically, the lid is taken from a cutting and creasing station to a position like the one shown in FIG. 7, in which it is at least to a great extend aligned with the box to be closed with the lid. If it should be slightly misaligned, once the lid is released, it will automatically be aligned with the side walls of the box when the hinged elements of the flap folding units that will now be described make contact with the flaps and start folding them down.

Figure 8:
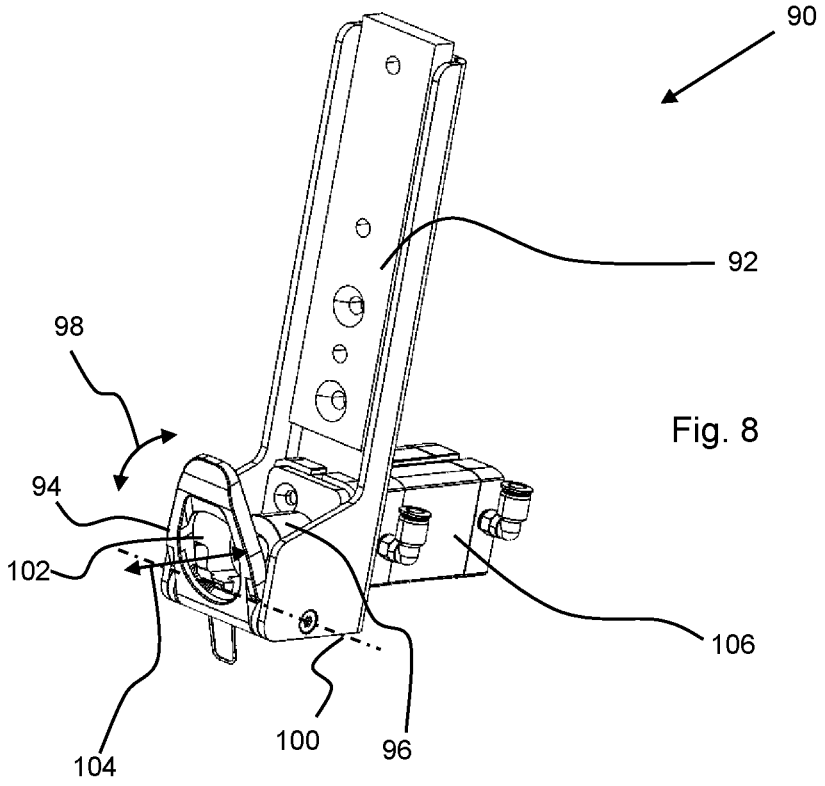
FIG. 8 is a perspective view onto the front side of a flap folding unit according to the invention.
Figure 9:
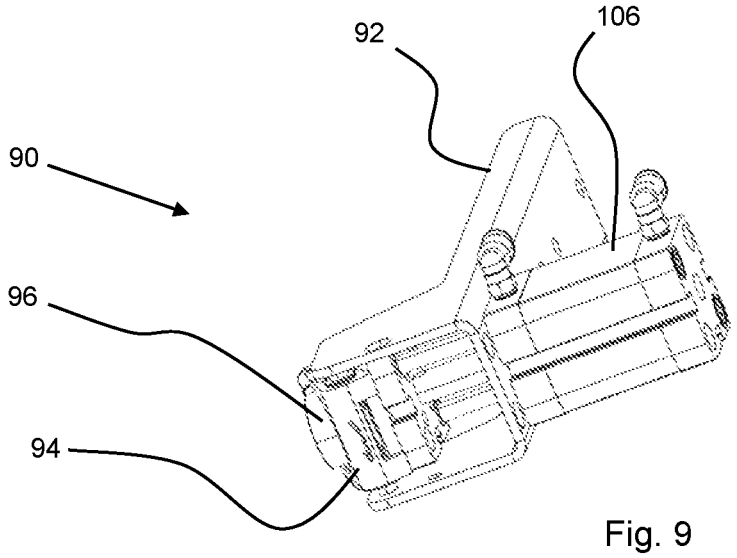
FIG. 9 is a perspective view onto the bottom side of a flap folding unit according to FIG. 8.

FIGS. 8 and 9 show a flap folding 90 unit according to one embodiment, which comprises a mounting body 92, a hinged element 94 and a pusher 96. As indicated by direction arrow 98, the hinged element 94 is pivotable about an axis indicated by the dash-dotted line 100 that runs substantially parallel to the crease line of a flap to be folded with the flap folding unit 90.

In this embodiment, the hinged element 94 is spring-preloaded into a position away from the mounting body 92 and thus towards a flap to be folded. In this embodiment, the hinged element 94 comprises an opening 102, through which the pusher 96 can be extended as indicated by direction arrow 104. The pusher 96 is moved forwards and backwards as indicated by direction arrow 104 by respective actuator structure integrated in a housing 106, and which may be of suitable type. For example, the pusher can be moved by a piston-cylinder unit, by an actuator like a step-motor or other electrical, mechanical, hydropneumatic or hydraulic means. In particular, the pusher 96 itself can form a piston and the housing 106 can form a respective cylinder, into which pressurized air or a hydraulic fluid is introduced respectively from which air or fluid is drawn in order to move the pusher as necessary.

FIGS. 10*a*-10*d* show four different stages of a flap folding process using a flap folding unit according to the invention. For folding a flap 76 down, typically three flap folding units 90 will be arranged along the flap 76, of which in this schematic side view only one unit 90 is visible.

Figure 10A:
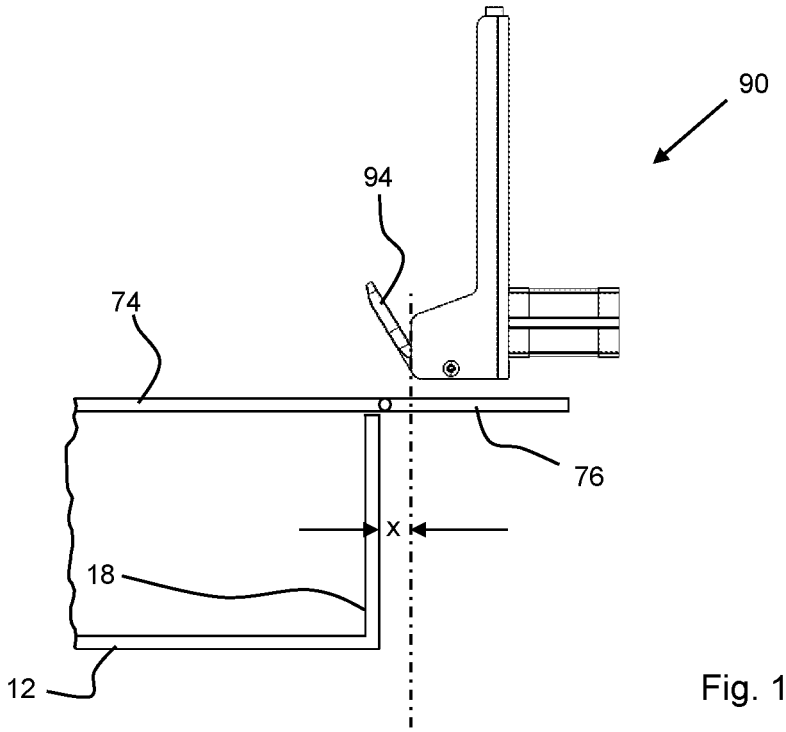
FIGS. 10A-10D are a schematic drawing showing four steps of a flap folding process employing a flap folding unit according to the invention.
Figure 10B:
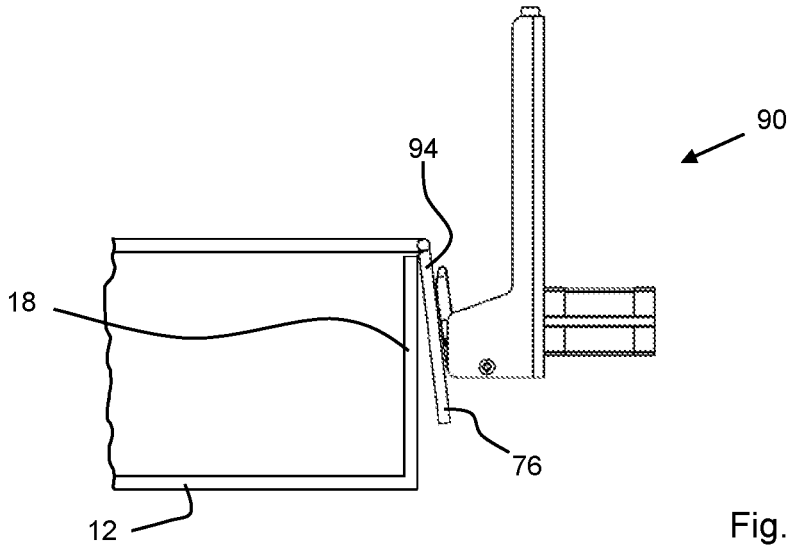

In the situation shown in FIG. 10A, a lid comprising a top panel 74 and a flap 76 has been placed on the side walls of a tray box such that the crease lines delimiting the flaps 76 from the top panel 74 run substantially along the free edges of the side walls, of which in FIG. 10A side wall 18 is visible. Hence, top panel 74 is substantially parallel to the bottom panel 12 of the tray box.

As indicated by x in FIG. 10A, there is a gap between the foremost edge of the flap folding unit 90 (not including the hinged element 94) and the side panel 18, which gap x is larger than the thickness of the flap 76. This allows large tolerances in the dimensions of the boxes and the lids and also ensures that when the hinged elements 74 make contact with the flaps 76, the lid still can move a bit, which will ensure automatic alignment of the lid with the box. As the shown embodiment is adapted for being used with custom-sized lids that vary in the dimensions, the flap folding unit 90 is as indicated in FIG. 10*a* first moved in a substantially horizontal direction along towards the lid and is stopped in a position as shown in FIG. 10A.

Figure 10C:
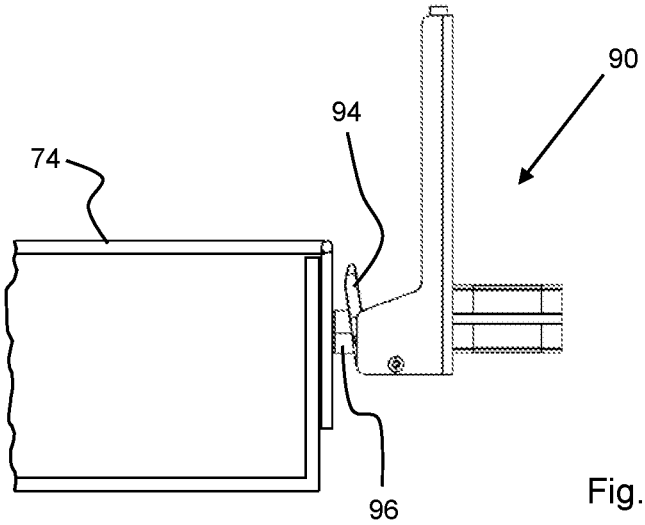

Depending on the layout of the lid and in particular the number of flaps to be folded, a flap folding apparatus will comprise multiple flap folding units 90, typically three to four units per flap. Once all respective flap folding units 90 are in position, they are preferably synchronously moved downwards, i.e. in a direction perpendicular to the bottom panel 12 of the box. In doing so, the hinged elements 94 of the flap folding units 90 come into contact with the respective flaps 76 and fold them towards their final position. As mentioned above, prior to this folding operation, glue is applied onto the side of the side panels facing the flaps and/or the side of the flaps facing the side panels, in particular at the positions, where the pushers 96 will press on the side of the flaps 76 facing away from the side panels to push the flaps towards the respective side panels. As the shown embodiment is adapted for being used with custom-sized lids, the length of the flaps 76 may vary so that the length of the movement of the flap folding units in said direction perpendicular to the bottom panel 12 of the box varies. The end position is a position, in which the respective pushers 76 are positioned close to the free edge of the respective flaps. In this position, as shown in FIG. 10C, the pushers are extended through the opening in the respective hinged elements 94 and press the respective flap 76 onto the respective side panel. The contact surface of each pusher 96 may be bulged. Preferably, the pushers 96 are made out of a material having good thermal conductivity, which facilitates fast curing of hot-melt glue provided between the respective side panels and the flaps in the regions, where the pushers make contact with the flaps.

Figure 10D:
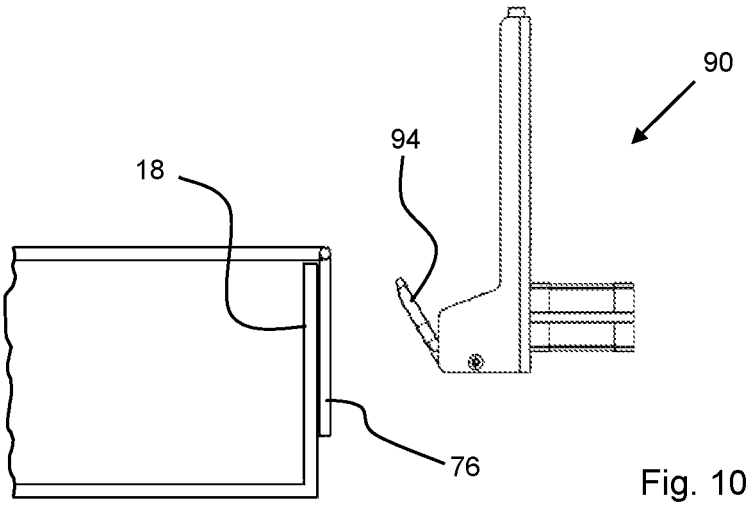

Once the glue is sufficiently cured, the pushers retract and, in a preferred embodiment as shown in FIG. 10D, the complete flap folding unit 90 retracts from the now closed box, which facilitates further handling of the box, in particular transporting the box towards other stations or a pick-up location.

Figure 11:
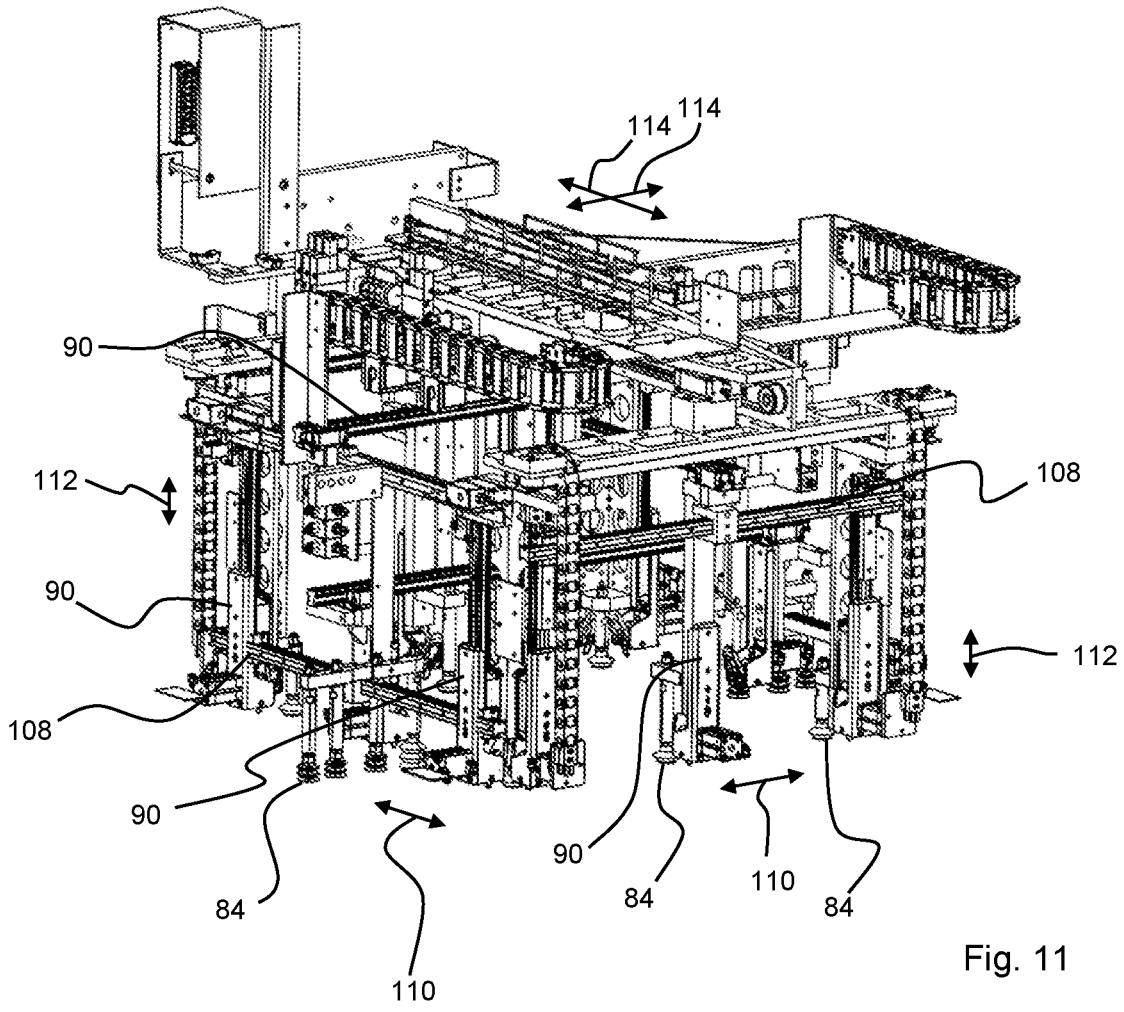
FIG. 11 is a perspective drawing of a lid placing station comprising a lid flap folding apparatus including 12 flap folding units according to the invention.

FIG. 11 shows schematically parts of a lid placing station employing a flap folding apparatus according to the invention, which in this embodiment comprises 12 flap folding units 90, of which for sake of clarity only some have been provided with reference numbers. The station also comprises suction units 84 for gripping respective lid blanks, of which also only some have been provided with reference numbers.

Figure 12:
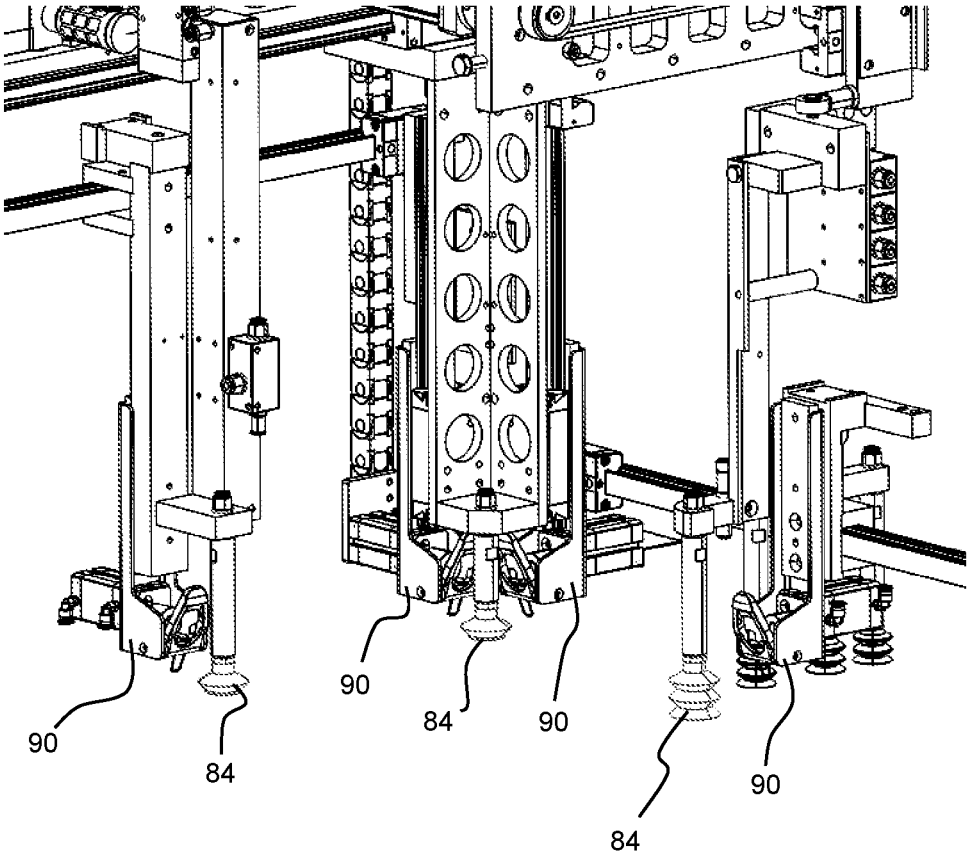
FIG. 12 is an enlarged view of a part of the lid placing station according to FIG. 11.

In the shown embodiment, four groups of three flap folding units 90 are arranged along rails 108 (again only some of the rails have been provided with reference numbers, which will also be true for further elements described below). The respective flap folding units 90 arranged on the same rail can be positioned along the respective rail with respect to each other as indicated by the direction arrows 110. As indicated by the direction arrows 112, the rails themselves are movable upwards and downwards, and, as indicated by direction arrows 114, towards and away from each other, so that each flap folding unit 90 is in this embodiment positionable in three dimensions. FIG. 12 is an enlarged view of a section of the lid placing station shown in FIG. 11.

Figure 13:
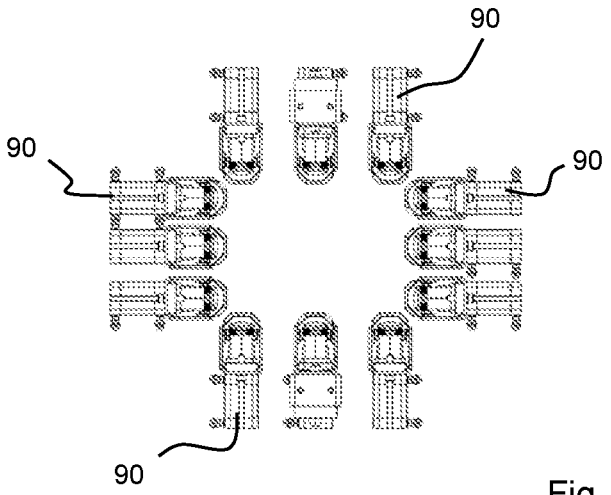
FIG. 13 is a schematic plan view of 12 flap folding units of a flap folding apparatus (not shown) in a first configuration.
Figure 14:
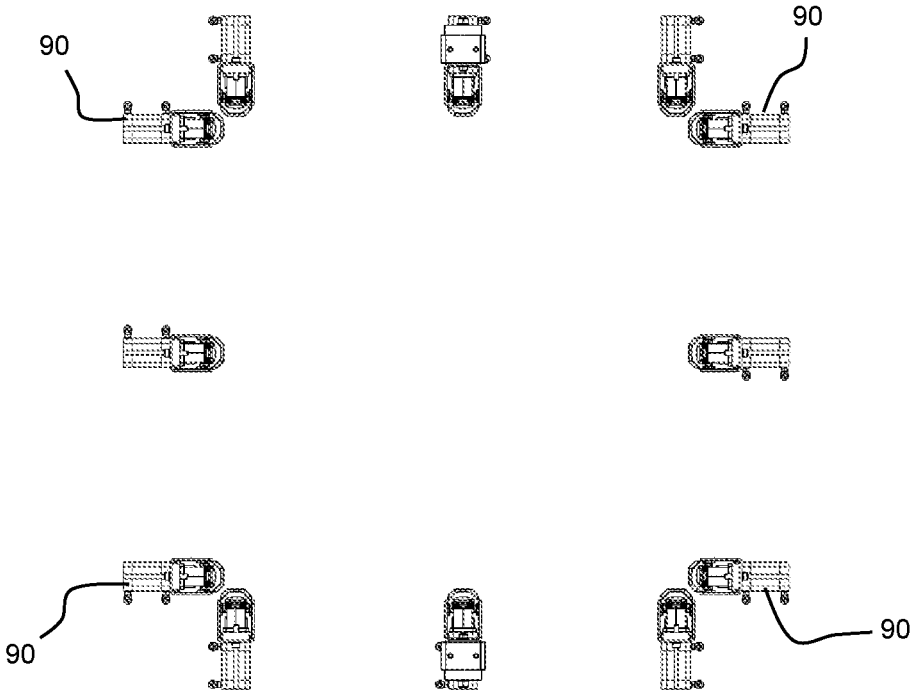
FIG. 14 is a plan view of the flap folding units according to FIG. 13 in a second configuration.

FIGS. 13 and 14 are top plan views of the flap folding units of the lid placing station shown in FIG. 11 positioned in two different arrangements for handling differently sized lids. As shown, the flap folding units can be brought very close together for handling small lids, or can be placed as shown in FIG. 14 for handling large lids. In use, typically one flap folding unit will be positioned close to opposing ends of each flap. If an uneven number of flap folding units is provided along each flap, one flap folding unit will preferably be positioned adjacent to the middle of the respective flap. If an even number of flap folding units is provided along a flap, two flap folding elements may preferably be positioned at equal distance from the middle of a flap.

Figure 15:
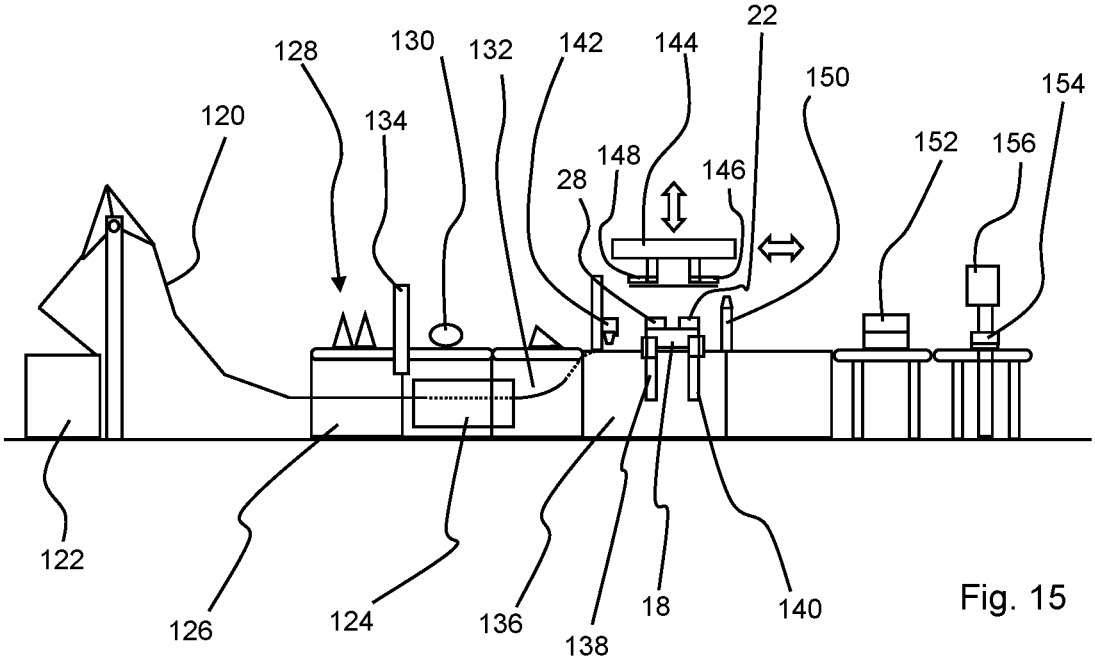
FIG. 15 is a schematic drawing of a system for automatically packaging items in custom-sized cardboard boxes according to a first embodiment.

FIG. 15 is a schematic diagram showing a system according to the invention. Cardboard 120 is supplied from a stack 122 of zig-zag folded cardboard to a cutting and creasing station 124 for cutting the cardboard, punching out slots between the corner panels and the side panels and introducing crease lines to delimit the respective panels from each other and to thus produce a blank for a custom-sized box. The respective dimensions of the panels are calculated based on information about the shipment set to be packaged, and the system comprises for this purpose a calculating unit, which can form part of a control unit for controlling the complete system and which may for example be integrated in a receiving unit 126, where items like the items 128, 130 and 132, which shall be packaged, are placed either automatically or manually.

The items to be packaged are transported via conveyor belts through a laser scanning unit 134, which measures the outer dimensions of the items passing through the unit in order to obtain information on the desired inner dimensions length LD, width WD and height HD a box needs to have in order to receive the items or the arrangement of items as they are, i.e. without re-arranging the items. Of course, the system could also be provided with structure for arranging the items in a certain manner for example to reduce the volume of a box needed. However, in this schematic drawing a simple and fast working embodiment is shown. The cardboard blank is transported from the cutting and creasing station 124 to a folding station 136, where the item or the items to be packaged are put on top of the bottom panel of the respective blank cut and creased in the cutting and creasing station. Respective grippers and folders like the gripping and folding units 138 and 140 fold the box around the item(s) to be packaged, i.e. erect all four corner panels, of which two, namely corner panels 22 and 28, are visible in this view upwards, then fold the end panels inwards thus folding also the corner panels inwards and finally the side panels, of which side panel 18 is visible in this view, upwards.

When the respective blank is transported from the station 124 to the station 136, it passes a glue application unit 142, which applies hot melt glue to the parts of the side panels, which are to be brought into contact with the corner panels.

To close the box, in this embodiment a lid placing station 144 is provided, which as indicated by the double-sided direction arrows is moveable upwards and downwards, forwards and rewards in the transport direction of the items respectively the boxes. Similar to the blanks for the box, based on the calculated dimensions a blank for the lid is produced and picked up by the lid placing station 144 with suction grippers.

In this schematic drawing, only flap folding units 146 and 148 of the lid placing station are shown. A gluing unit 150 applies hot-melt glue to the end panels and the side panels of the lid, which is placed on top of the box that just has been erected, upon which the flaps of the lid are folded down and closed. The thus closed boxes 152, 154 are then transported via respective conveyor belts to a label printing and application unit 156, which puts a label including for example the address of the recipient and postage on the boxes, which then can be picked up and further transported. The lid can be created from the same cardboard supplied as the box, in case of which the cutting and creasing station may be set up to produce not only a blank for the box, but also a blank for the lid, which may then be transported via respective conveyor belts to the lid placing station, which picks up the lid and puts it on top of the box.

Figure 16:
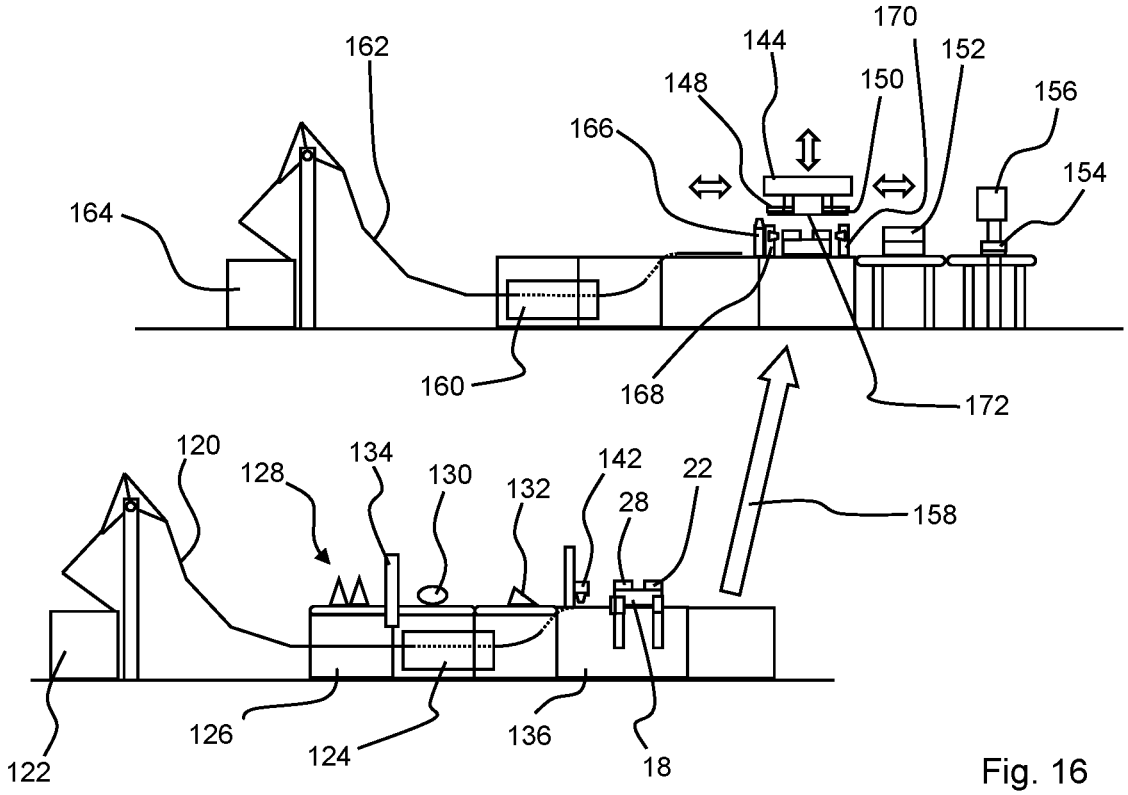
FIG. 16 is a schematic drawing of a system for automatically packaging items in custom-sized cardboard boxes according to a second embodiment.

FIG. 16 schematically shows an embodiment of a system according to the invention, which comprises separate production lines for producing the boxes and the lids, which could increase the through-put of the system. The items 128, 130 132 are scanned, blanks are produced from cardboard 120 and boxes are folded around the items via respective stations 124, 126, 136 as shown in FIG. 15. However, the boxes are then transported as indicated by direction arrow 158 to a lid creation and placing line, in which lid blanks are produced more or less parallel to producing the boxes. Like the box creation line, the lid blank production line comprises a station 160 for cutting and creasing cardboard 162 supplied from a stack 164 of cardboard, which may correspond to the cardboard used for producing the boxes or which may have different properties, in particular different widths, strengths, branding etc. It is also possible to provide the lid production line with different cardboard supplies so that depending for example on the dimensions needed for a respective lid, a cardboard can be chosen that allows reducing the amount of waste produced upon producing the lid. As described above, it may be that the lid is cut out from the cardboard supplied in a "rotated" manner, i.e. such that seen in the transport direction of the cardboard the side panels are in front and in the rear of the top panel of the lid, whereas the end panels are to the left and the right of the top panel. In order to properly align the box and the lid, the system may comprise a box rotating unit, in which during transporting the box from the box line to the lid production and placing line the box is rotated, if necessary, by 90° in order to align the lid and the box. As is apparent from the present application, of course instead of rotating the box, if is necessary at all, the lid may be rotated by 90°.

Both production lines comprise glue application units 142, 166, 168 and 170. In this embodiment, the lid placing station 144 comprises a separate glue unit 166 for applying hot-melt glue to the side panels in the transport direction of the cardboard of the lid 172 to be placed on a box, and two glue units 168 and 170 for applying holt-melt glue to the end panels of the box where the end panels of the lid have to be attached to the box.

Figure 17A:
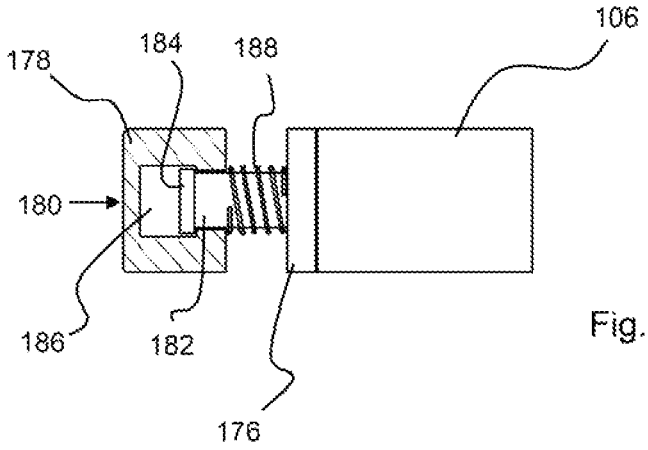
FIGS. 17A and 17 B are a schematic drawing showing some of the parts of a folding unit according to another embodiment of the invention in different stages.
Figure 17B:
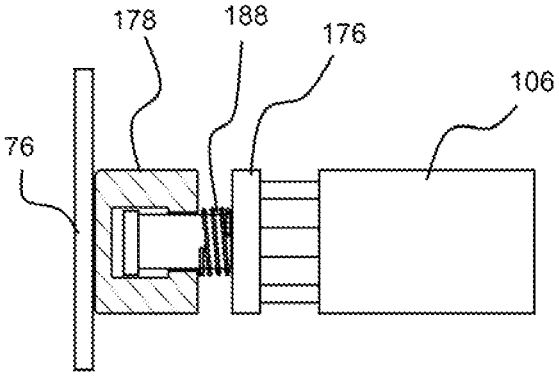

FIGS. 17*a* and 17*b* show a pusher 176, which again—like the pusher 96 shown e.g. in FIG. 8—is extendable from and retractable into a housing 106. FIG. 17A shows the pusher 176 in the retracted, FIG. 17B in the extended position. The basic difference between the pusher 96 shown in FIG. 8 and the pusher 176 shown in FIGS. 17A and 17B is the fact that pusher 176 is provided with a spring-preloaded end cap 178, which allows to even better compensate any tolerances in the lid sizes and to align the front of the pusher, i.e. end cap front face 180 with the flap to be pressed. FIG. 17B shows the situation in which the cap 178 is in contact with a flap 76. The spring-preloaded end cap is one example of an elastic element that can be provided at the end of the pusher 176 adapted for contacting the flap to be pushed.

The pusher 176 has a punch 182 with an enlarged-diameter end section 184 which is accommodated in an undercut cavity 186 in the cap 178. A helical spring 188 is arranged between the cap 178 and the pusher 176 such that it pushes the cap 178 away from the pusher 176. As shown in FIG. 17B, when the pusher 176 is extended and moved towards a flap 76, the spring 188 is compressed and ensures that the end cap 178 makes smooth contact with the flap 76.

In one embodiment, the pushers may be adapted to apply different forces at different positions of the lid flap. For example a higher force may be used near the corners of the box, where the adjacent perpendicular side panel provides a counterforce. In the middle of a lid flap a lower force may be used to prevent pushing the side panel of the box away, therewith reducing the bonding surface with the lid. If the pushers are provided with elastic elements at their ends like the spring-preloaded end caps mentioned above, choosing the respective elastic elements differently, e.g. stronger springs for pushers intended to work near the corners of a lid flap and weaker springs for pushers intended to work in or close to the middle of a lid flap, allows adjusting the applied forces easily.

LIST OF REFERENCE NUMBERS

10 cardboard blank
12 bottom panel
14 first end panel
16 second end panel
18 first side panel
20 second side panel
22, 24 first corner panel
26, 28 second corner panel
30-44 crease line
46-52 slot
54 box
60 folding station
62 panel folding element
64-68 rod
72 lid
74 top panel
76 flap
84 suction unit
86 suction cup
90 flap folding unit
92 mounting body
94 hinged element
96 pusher
98 direction arrow
100 axis
102 opening
104 direction arrow
106 housing
108 rail
110-114 direction arrow
120 cardboard
122 stack of zig-zag folded cardboard
124 cutting and creasing station
126 receiving unit
128-132 item
134 laser scanning unit
136 folding station
138, 140 folding unit
142 glue application unit
144 lid placing station
146, 148 flap folding unit
150 gluing unit
152, 154 box
156 label printing and application unit
158 direction arrow
160 cutting and creasing station
162 cardboard
164 stack of cardboard
166-170 glue application unit
172 lid
176 pusher
178 end cap
180 end cap front face
182 punch
184 end section
186 cavity
188 helical spring
$H_{CP}$ height of corner panel
$H_{EP}$ height of end panel
$H_{SP}$ height of side panel
$H_{SP}$ height of side panel
$L_{BP}$ length of bottom panel
$L_{CP}$ length of corner panel
$L_{SP}$ length of side panel
$W_{BP}$ width of bottom panel
$W_{EP}$ width of end panel
x gap

The invention claimed is:

1. A flap folding unit for folding flaps of lids of boxes, comprising:

a hinged guiding element adapted for contacting a flap to be folded upon relative movement of the guiding element and the flap and guiding the flap towards a final position of the flap, and an extendable pusher adapted for pushing the flap into the final position of the flap, wherein the hinged guiding element comprises an opening, through which the extendable pusher is extendable to push the flap.

2. The flap folding unit according to claim 1, further comprising: a mounting body holding the guiding element and the extendable pusher, the guiding element being spring-preloaded towards a position away from the mounting body.

3. The flap folding unit according to claim 1, wherein the extendable pusher comprises a spring-preloaded end cap, at an end of the extendable pusher that is adapted to contact the flap to be pushed.

4. The flap folding unit according to claim 1, characterized in that the pusher is extendable in a controlled manner by a hydraulic or a pneumatic piston-cylinder-unit or an electric actuator.

5. A flap folding apparatus for folding flaps of lids of boxes, comprising:

a plurality of flap folding units for folding flaps of lids of boxes, each flap folding unit comprising a hinged guiding element adapted for contacting a flap to be folded upon relative movement of the guiding element and the flap and guiding the flap towards a final position of the flap, and an extendable pusher adapted for pushing the flap into the final position of the flap, and structure for moving the plurality of flap folding units relative to a lid comprising at least one flap to be folded, wherein the flap folding apparatus is adapted for folding flaps of lids comprising at least two flaps at opposite sides of the lids, wherein a first plurality of said flap folding units is arranged along a first one of said flaps and a second plurality of said flap folding units is arranged along a second one of said flaps, further comprising structure for adjusting the distance between said first and said second plurality of flap folding units.

6. The flap folding apparatus according to claim 5, characterized in that the distance between at least some of the flap folding units is automatically adjustable.

7. The flap folding apparatus according to claim 5, characterized in that some flap folding units are arranged on a common rail, along which they are automatically positionable with respect to each other.

8. The flap folding apparatus according to claim 5, characterized:

by comprising structure for positioning at least some of the flap folding units such that a flap folding unit is positioned adjacent to a middle of each flap to be folded when an uneven number of flap folding units is provided to be positioned along each flap to be folded, or by comprising structure for positioning at least some of the flap folding units such that two adjacent flap folding units are positioned at even distance to the middle of each flap to be folded, when an even number of flap folding units is provided to be positioned along each flap to be folded.

9. The flap folding apparatus according to claim 5, characterized in that the flap folding units are arranged on a common structure for moving them in a direction substantially perpendicular to a top panel of a lid comprising the flaps to be folded.

10. The flap folding apparatus according to claim 5, wherein each flap folding unit comprises a mounting body holding the guiding element and the extendable pusher, the apparatus further comprising structure for arranging the distance of each mounting body to an adjacent side wall of a box, onto which a flap of a lid is to be folded such that a gap remains between the mounting body and the respective flap in the folded position.

11. A method for folding the flaps of a lid blank comprising a top panel and at least one flap joined over a crease line to said top panel, comprising:

positioning at least two flap folding units for folding flaps of lids of boxes along each flap to be folded, each flap folding unit comprising a hinged guiding element adapted for contacting a flap to be folded upon relative movement of the guiding element and the flap and guiding the flap towards a final position of the flap, and an extendable pusher adapted for pushing the flap into the final position of the flap, moving the respective flap and the respective flap folding units relative to each other along a direction perpendicular to the respective crease line such that the hinged elements come into contact with the flap and fold it towards the final position of the flap, and extending said pushers to push the flap into the final position of the flap.

12. A system for automatically packaging varying shipment sets in custom-sized cardboard boxes, comprising:

a system for obtaining information on the overall length, width and height dimensions of a shipment set consisting of one or more item(s) to be packaged, calculating, based on said information, the layout of a cardboard box blank for a box comprising a polygonal bottom panel defined by three or more bottom panel edges and side walls joined over respective crease lines to said bottom panel edges, each side wall forming in the folded state a substantially right angle with a bottom panel, and calculating, based on said information, the layout of a lid blank, comprising a polygonal top panel corresponding to the bottom panel of the box and flaps joined over respective crease lines to said top panel edges and adapted for being folded onto a corresponding one of said side walls, structure for cutting and creasing cardboard to have the calculated box blank and lid blank layouts, structure for folding a box out of said cardboard box blank, structure for placing the shipment set on the bottom panel prior or after erecting the side walls, and the system according to claim 11 for automatically closing the box with a cardboard lid folded from said cardboard lid blank.

13. A method for automatically packaging varying shipment sets in custom-sized cardboard boxes, comprising:

obtaining the overall length, width and height dimensions of a shipment set consisting of one or more item(s) to be packaged, calculating, based on said information, the layout of a cardboard box blank for a box comprising a polygonal bottom panel defined by three or more bottom edges and side walls joined over respective crease lines to said bottom panel edges, each side wall forming in the folded state a substantially right angle with the bottom panel, and calculating based on said information the layout of a cardboard lid layout for a lid comprising a polygonal top panel corresponding to the bottom panel of the box to be closed and flaps joint over respective crease lines to said top panel edges and adapted for being folded onto a corresponding one of said side walls, cutting and creasing cardboard to form a cardboard box blank and a cardboard lid blank having the calculated layouts, conveying the shipment set onto the bottom panel prior or after folding a box out of said cardboard box blank, closing the box with a lid employing the method according to claim 11.

14. A system for automatically closing a tray box with a cardboard lid, said box comprising a polygonal bottom panel defined by three or more bottom panel edges and side walls joined over respective crease lines to said bottom panel edges, each side wall forming a substantially right angle with the bottom panel, the system comprising a lid placing station comprising:

structure for gripping a cardboard blank for a lid comprising a polygonal top panel corresponding to the bottom panel of the box to be closed and flaps joined over respective crease lines to top panel edges and adapted for being folded onto a corresponding one of said side walls, and flap folding units for folding flaps of lids of boxes, each flap folding unit comprising a first hinged guiding element that is spring biased towards a contacting position to contact a flap to be folded upon relative movement of the first hinged guiding element and the flap and guiding the flap towards a final position of the flap and a first extendable pusher adapted for pushing the flap into the final position of the flap and/or a flap folding apparatus for folding flaps of lids of boxes, comprising a plurality of flap folding units for folding flaps of lids of boxes, each flap folding unit comprising:

a second hinged guiding element that is spring biased towards a contacting position to contact a flap to be folded upon relative movement of the second hinged guiding element and the flap and guiding the flap towards the final position of the flap, and a second extendable pusher adapted for pushing the flap into the final position of the flap, and structure for moving the plurality of flap folding units relative to a lid comprising at least one flap to be folded.

* * * * *